United States Patent [19]

Wendt

[11] Patent Number: 4,513,557

[45] Date of Patent: Apr. 30, 1985

[54] CLIP FOR USE WITH RUNNER AND RUNNER ASSEMBLY INCLUDING THE CLIP

[75] Inventor: Alan C. Wendt, Barrington, Ill.

[73] Assignee: United States Gypsum Company, Chicago, Ill.

[21] Appl. No.: 582,547

[22] Filed: Feb. 22, 1984

[51] Int. Cl.[3] ..... E04C 3/08

[52] U.S. Cl. ..... 52/735; 52/242; 52/716

[58] Field of Search ..... 52/341, 238.1, 290, 52/242, 241, 713, 715, 479, 720, 481, 762, 716, 52/717, 718, 735

[56] References Cited

U.S. PATENT DOCUMENTS

| | | | |
|---|---|---|---|
| 675,487 | 6/1901 | Kunneke | 52/341 |
| 1,960,078 | 5/1939 | Bohnsack et al. | 52/242 |
| 3,908,328 | 9/1975 | Nelsson | 52/242 |
| 3,924,373 | 12/1975 | Lizdas et al. | 52/716 |
| 3,998,027 | 12/1976 | Wendt et al. | 52/716 |

FOREIGN PATENT DOCUMENTS

| | | | |
|---|---|---|---|
| 245212 | 2/1966 | Australia | 52/762 |

*Primary Examiner*—J. Karl Bell
*Assistant Examiner*—Creighton Smith
*Attorney, Agent, or Firm*—Samuel Kurlandsky; Robert M. Didrick; Robert H. Robinson

[57] ABSTRACT

An integral clip for use in combination with a channel-form runner for securing a pair of parallel spaced-apart wallboard panels in a demountable wall structure, the channel having integral means for retaining the clip therein, the clip having means for supporting the wallboard panels within the runner, wherein a runner of single dimension may be utilized to retain wallboards of different thicknesses by utilizing clips of various dimensions.

14 Claims, 8 Drawing Figures

CLIP FOR USE WITH RUNNER AND RUNNER ASSEMBLY INCLUDING THE CLIP

BACKGROUND OF THE INVENTION

1. Field of the Invention

The present invention relates to building construction, and more particularly concerns clips adapted for use with a runner to support parallel spaced-apart wallboards, wherein different sized clips may be utilized to support wallboards of different thicknesses within the same size runner.

2. Description of the Prior Art

In the assembly of wall panels to construct a wall, and particularly a demountable wall, it is conventional to provide elongate channel members, called runners, for retaining the edges of panels. This is particularly true in constructions made from gypsum wallboard panels. The runners are secured to the floor and ceiling, thereby fixing the position of the wall with respect thereto. Such runners may have a variety of shapes, but more generally have a channel-form shape, and invariably require an inner panel supporting surface for each panel, and a side flange angularly depending from the runner exterior to the panel to hide the irregular edges characteristics of the panels. For walls of the cavity type which permit the storage of utilities and the use of two rows of wallboard each of which is decorated on only the exterior face, two rows of inner supporting surfaces and two side flanges are required. The runners may be manufactured in a variety of ways and from a variety of materials. One of the least expensive fabrication means is to roll-form metal strips into the desired channel shape.

A reduction in metal can be achieved by lancing the inner support surfaces out of the web of the runner which joins the two side flanges together. That is, the web need not be one solid piece of full length of the runner. This may be done wherein the inner support surfaces are tabs which are struck or bent out of the web along a longitudinal junction line, to a position extending generally parallel to the side flanges with which they cooperate to hold a panel edge. Such construction, however, suffers from a lack of sufficient traverse support for the lanced tabs. The result is that, as the panels are pushed against the tabs during the mounting of the panels within the runners, the tabs tend to bend permanently inwardly back toward the web of the runner. Such deflection of the tabs results in a loose fit of the panels within the runner, which usually is an unacceptable condition. Even if the contractor is careful in the erection of the panels to minimize such bending of the tabs, the tabs still are subjected to repeated transverse forces resulting from blows delivered to the face of the panel during use.

In U.S. Pat. No. 3,908,328, a structure is shown wherein tabs are struck out of the web of a runner perpendicular to the web and perpendicular to the longitudinal direction of the runner. Flanges may also be formed at the edges of the tabs for engaging the inner surfaces of the wallboard panels. This structure provides good strength in resisting deformation. However, after the tabs are formed, the thickness of the wallboard panels which may be inserted between the tabs and the flanges of the runners are fixed in dimension. Consequently, if wallboard panels of different thickness are utilized, runners with tabs struck in different positions must be purchased and utilized.

SUMMARY OF THE INVENTION

It is an object of the invention to provide a clip for use with a runner for securing and supporting a wall formed of spaced-apart parallel wall panels such as gypsum wallboard panels or other wall panels such as cement board panels.

It is a further object of the invention to provide a runner and clip combination wherein a single size runner may be utilized to support and secure wall panels of different thicknesses by utilization of clips of different dimensions.

It is a further object of the invention to provide a structure of the type described which utilizes relatively inexpensive materials and which may be readily fabricated at moderate costs.

Other objects of the invention will become apparent upon reference to the following description and accompanying drawings.

According to the invention, a channel-form runner is provided having integral means in its web for receiving and securing a clip. The clip is provided with complementary means for being secured to the web. The clip is provided with flanges which cooperate with the flanges of the runner to form slots for retaining the edges of panels. Panels of different thicknesses may be utilized with the same size runner by varying the size of the clips.

DESCRIPTION OF THE PREFERRED EMBODIMENTS

Figure 1:
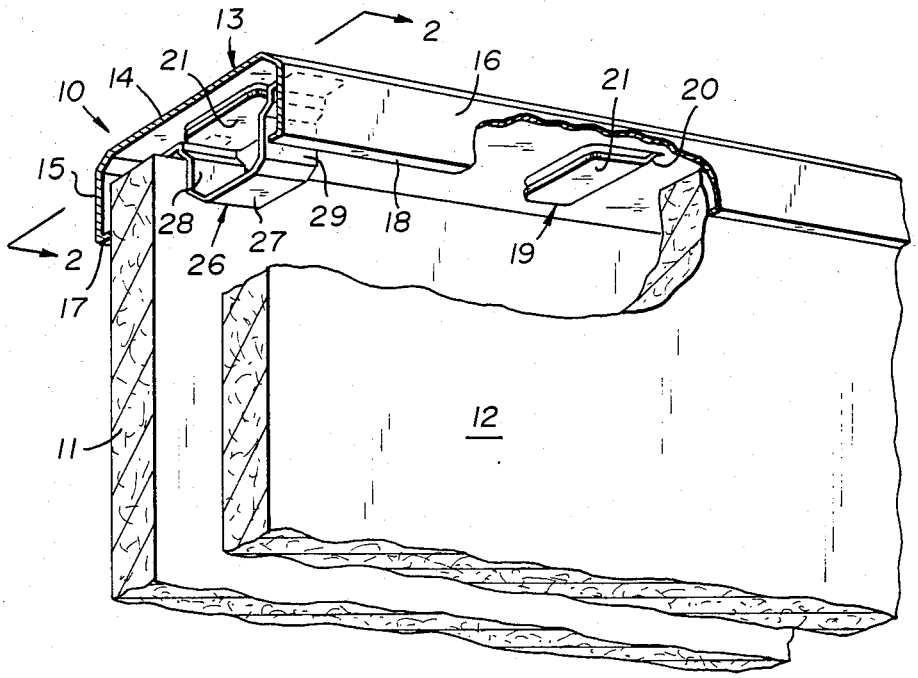
FIG. 1 is a perspective view partly broken away of a wall structure according to the invention.
Figure 2:
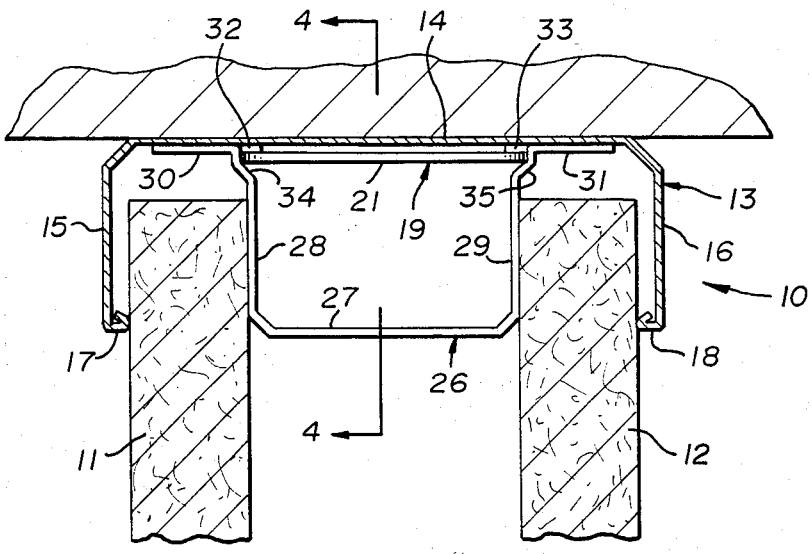
FIG. 2 is a cross-sectional view taken at the line 2—2 of FIG. 1, looking in the direction of the arrows.
Figure 4:
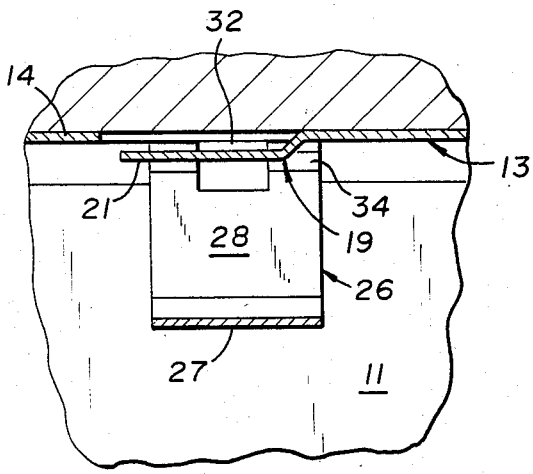
FIG. 4 is a cross-sectional view taken at the line 4—4 of FIG. 2, looking in the direction of the arrows.
Figure 5:
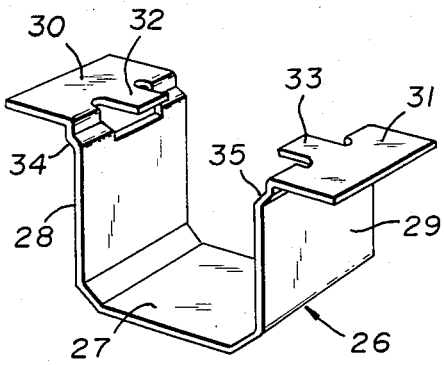
FIG. 5 is a perpsective view of a clip according to the invention.
Figure 6:
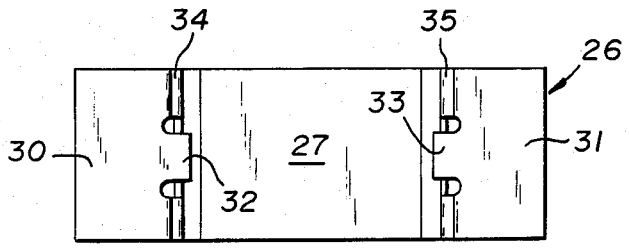
FIG. 6 is a top view of the clip shown in FIG. 5.
Figure 7:
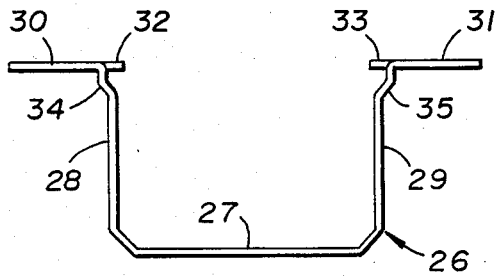
FIG. 7 is a front view of the clip shown in FIGS. 5 and 6.
Figure 8:
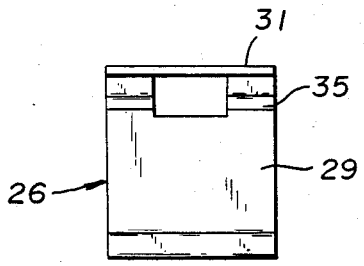
FIG. 8 is a side view of the clip shown in FIGS. 5, 6 and 7

Referring to FIGS. 1, 2 and 4, a wall structure is shown comprising a combination runner and clip structure 10 including parallel spaced-apart wall panels such as gypsum wallboard panels 11 and 12. Cooperating with the clip for maintaining the wallboard panels in position is a runner 13 comprising a web 14 and two flanges 15 and 16. The flanges 15 and 16 are provided with inwardly-directed lips 17 and 18, respectively, for engaging the outer surfaces of the wallboard panels. A tab or tongue 19 is struck down from the web 14 and comprises an oblique attachment base 20 and a tab member 21 substantially parallel to the plane of the web 14.

As viewed more particularly in FIGS. 5–8, the clip 26 of the invention is shown. The clip is integral and formed of any suitable material such as aluminum or steel. The clip 26 comprises a web 27, flanges 28 and 28, and tabs 30 and 31 directed outwardly and at an angle of approximately 90° with respect to the flanges 28 and 29. Struck from the flanges 28 and 29 and the tabs 30 and 31 are inwardly directed tongues 32 and 33. Offsets 34 and 35 are provided to permit different size clips to be used with a runner having the same size tab 19.

In assembling the structures of FIGS. 1, 2 and 4, the clips are inserted within the runner with the tongues 32 and 33 engaged in the space formed between the struck down tab 19 and the inner surface of the web 14. The ends of the outwardly directed tabs 30 and 31 engage the inner surface of the web 14. The clips 26 are strongly retained by the tab 19. The wall panels 11 and 12 are inserted in the channels formed by the flanges 15 and 16 of the runner 13 and the flanges 28 and 29 of the clip 26. If wall panels having a greater thickness are desired to be used, an alternative clip 26 may be utilized wherein the flanges 28 and 29 are positioned closer together, thereby providing wider channels which will receive thicker wall panels.

Figure 3:
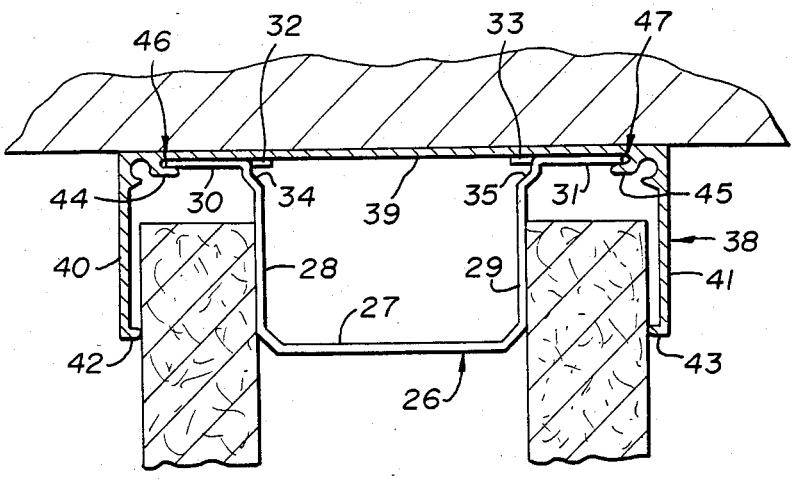
FIG. 3 is a cross-sectional view of a wall structure similar to that of FIGS. 1 and 2, but utilizing a somewhat modified runner structure.

Referring to FIG. 3, a modified embodiment of the invention is shown. This embodiment utilizes a runner 38 formed of extruded aluminum. The runner comprises a web 39, and flanges 40 and 41 having inwardly directed lips 42 and 43. Formed on the web 39 are protuberances 44 and 45 defining slots 46 and 47. In this embodiment the tongues 32 and 33 are not utilized, but the edges of the outwardly directed tabs 30 and 31 are engaged in the slots 46 and 47, respectively. This structure operates in the same manner as that of FIGS. 1, 2 and 4 in most respects.

The present invention has a number of advantages over structure in the prior art designed for similar purposes. It provides a simple structure which may be formed of conventional materials and conventional machinery. The materials and methods are relatively inexpensive. Moreover, instead of providing runners in a number of sizes in order to utilize wall panels such as gypsum wallboard panels of different thicknesses, the present invention permits the use of a runner of only a single size, and various thicknesses of wall panels may be utilized merely by choosing the proper size clip, an expediency which is much cheaper than providing runners of many sizes.

While the present invention has been disclosed in the light of specific embodiments thereof, it is evident that many alternatives, modifications, and variations may be readily apparent to one skilled in the art in the light of the foregoing disclosure. Accordingly, the disclosure is intended embrace all such alternatives, modifications and variations as may fall within the spirit and scope of the invention as defined in the following appended claims.

What is claimed is:

1. A clip adapted to be inserted and retained in a channel-form runner having integrally provided retention means for retaining said clip and cooperating with said runner to retain wall panels, said clip being channel-form and comprising a web, a pair of substantially parallel clip flanges each connected at one edge to an edge of said web, a pair of flat outwardly directed tabs, one extending from the outer edge of each of said clip flanges, and a pair of flat inwardly directed tabs, one tab struck from each of said clip flanges, said outwardly directed tab and said inwardly directed tabs being coplanar and substantially perpendicular to said clip flanges and adapted to engage retention means provided in said runner.

2. A clip according to claim 1, wherein an offset is provided between said clip flanges and said outwardly directed tabs to permit said clip flanges to be altered to accommodate wall panels of different thicknesses without altering said runners.

3. In combination, a channel-form runner and a channel-form clip affixed thereto, said combination cooperating to define slots for receiving and retaining the edges of wall panels in spaced-apart relationship, said runner comprising:

(1) a web having integral clip-retaining means provided on web thereon, (2) a pair of parallel spaced-apart flanges at the edges thereof, and said clip comprising:

(1) a web, (2) a pair of spaced-apart substantially parallel clip flanges each connected at one edge to an edge of said web, (3) a pair of outwardly-directed tabs, one tab extending from the other edge of each of said clip flanges, and (4) a pair of inwardly-directed tabs, one tab struck from each of said clip flanges, said outwardly directed tabs or said inwardly directed tabs engaging the clip-retaining means provided on the web of said runner.

4. A combination according to claim 3, wherein the outwardly-directed tabs and the inwardly-directed tabs of said clip are substantially perpendicular to said clip flanges.

5. A combination according to claim 4, wherein the outwardly-directed tabs and the inwardly-directed tabs of said clip are substantially coplanar.

6. A combination according to claim 3, wherein the integral clip-retaining means provided on the web of said runner comprises a struck-down tab substantially parallel to said web.

7. A combination according to claim 3, wherein the integral clip-retaining means provided on the web of said runner comprises a pair of protuberances each defining a slot, the ends of said outwardly-directed tabs on said clip being engaged and retained within said slots.

8. A combination according to claim 3, wherein an offset is provided between said clip flanges and said outwardly directed tabs to permit the width of said struck-down runner tab to remain constant in size while the dimensions of said clip flanges are altered to accommodate gypsum wallboard panels of different thicknesses.

9. A wall structure comprising:

A. in combination, a channel-form runner and a channel-form clip affixed thereto, said combination cooperating to define slots for receiving and retaining the edges of panels in spaced-apart relationship, said runner comprising:

(1) a web having integral clip-retaining means provided on web thereon, (2) a pair of parallel spaced-apart flanges at the edges thereof, and said clip comprising:

(1) a web, (2) a pair of spaced-apart substantially parallel clip flanges each connected at one edge to an edge of said web, (3) a pair of outwardly-directed tabs, one tab extending from the other edge of each of said clip flanges, and (4) a pair of inwardly-directed tabs, one tab struck from each of said clip flanges, said outwardly directed tabs or said inwardly directed tabs engaging the clip-retaining means provided on the web of said runner, and B. a pair of spaced-apart substantially parallel panels having edges retained in the slots formed by said ruhner and said clip.

10. A wall structure according to claim 9, wherein the outwardly-directed tabs and the inwardly-directed tabs of said clip are substantially perpendicular to said clip flanges.

11. A wall structure according to claim 10, wherein the outwardly-directed tabs and the inwardly-directed tabs of said clip are substantially coplanar.

12. A wall structure according to claim 9, wherein the integral clip-retaining means provided on the web of said runner comprises a struck-down tab substantially parallel to said web.

13. A wall structure according to claim 9, wherein the integral clip-retaining means provided on the web of said runner comprises a pair of protuberances each defining a slot, the ends of said outwardly-directed tabs of said clip being engaged and retained within said slots.

14. A wall structure according to claim 9, wherein an offset is provided between said clip flanges and said outwardly-directed tabs to permit the width of said struck-down runner tab to remain constant in size while the dimensions of said clip flanges are altered to accommodate gypsum wallboard panels of different thicknesses.

* * * * *

UNITED STATES PATENT AND TRADEMARK OFFICE

CERTIFICATE OF CORRECTION

PATENT NO. : 4,513,557

DATED : April 30, 1985

INVENTOR(S) : Alan C. Wendt

It is certified that error appears in the above—identified patent and that said Letters Patent is hereby corrected as shown below:

Column 2, line 68, change the last numeral "28" to --29--.

Signed and Sealed this

*Twenty-fourth* Day of *September 1985*

[SEAL]

*Attest:*

DONALD J. QUIGG

*Attesting Officer*

*Commissioner of Patents and Trademarks—Designate*